United States Patent [19]

Bolton et al.

[11] Patent Number: 4,867,213

[45] Date of Patent: Sep. 19, 1989

[54] SYSTEM FOR ORIENTING LOGS FOR LUMBER PROCESSING

[75] Inventors: William E. Bolton; John C. Holbert, both of Corvallis; Jeffrey D. Ballance, Albany; Robert A. Records, Newberg, all of Oreg.

[73] Assignee: U.S. Natural Resources, Inc., Portland, Oreg.

[21] Appl. No.: 321,305

[22] Filed: Mar. 10, 1989

Related U.S. Application Data

[63] Continuation-in-part of Ser. No. 150,937, Feb. 1, 1988, Pat. No. 4,811,776.

[51] Int. Cl.[4] ..... B27B 1/00

[52] U.S. Cl. ..... 144/357; 83/364; 83/367; 356/385; 364/474.09; 144/209 A; 144/378

[58] Field of Search ..... 83/367, 364; 144/356, 144/357, 209 A, 378; 356/385, 372; 364/475, 560, 563, 564

[56] References Cited

U.S. PATENT DOCUMENTS 4,811,776 3/1989 Bolton et al. ..... 144/209 A

*Primary Examiner*—W. Donald Bray

*Attorney, Agent, or Firm*—Robert L. Harrington

[57] ABSTRACT

A system that rotatively orients and skew positions a log for lumber processing. A log is placed in centering V's and rough centered. Rotatable scan spindles rotate the log while scanners obtain measurements at spaced locations along the log length and at selected rotative positions. Each angular position is analyzed for an optimum cutting pattern and the spindles are rotated to rotate the log into the most desirable angular position. The log is skew adjusted by the scan spindles and/or knee clamps in a carriage and conveyed to a saw array. A computer controls the cutting action to achieve the selected cutting pattern.

9 Claims, 4 Drawing Sheets

SYSTEM FOR ORIENTING LOGS FOR LUMBER PROCESSING

This is a continuation in part of U.S. Ser. No. 150,937, filed Feb. 1, 1988 now U.S. Pat. No. 4,811,776.

FIELD OF THE INVENTION

This invention relates to orientation of logs for lumber processing and more particularly to a method and apparatus for determining a desired rotative position as well as skew position for the logs.

BACKGROUND OF THE INVENTION

In processing a log for producing lumber, it is common to clamp the log on or in a saw carriage or overhead conveyor so that the log length is aligned with a saw or saw array. The carriage or conveyor then conveys the log in one or more passes through the saw to cut the log into flitches or slabs, and generally a center cant of desired dimensions. There are a number of variations to the process and a number of different apparatus that make up the various components, at least in part dictated by the size of the log being processed and the type of lumber being produced.

A major concern of the lumber producing process in general is that the process maximize utilization of the log. It has long been recognized that small angular shifting of the log axis relative to the saw's cutting line can dramatically impact this utilization. (Hereafter this angular positioning of the log axis is referred to as skew positioning to differentiate it from rotative positioning of the log to be described hereafter.)

To achieve the desired skew positioning, it has been common to measure the lateral dimension of the log at spaced positions along the log length. This enables the development of a model of the log for computer analysis. A computer computes the potential lumber production from the log at various skew positions within the log model and selects a preferred skew position for the log. Positioning apparatus then repositions the log axis to achieve the desired skew position. Such repositioning apparatus may be a part of the carriage mechanism or it may be a separate apparatus that repositions the log prior to the log being clamped, e.g. in the overhead conveyor. A process and apparatus for skew positioning of a log for lumber processing is disclosed in U.S. Pat. No. 3,786,968 issued to Mason, et al on June 5, 1973.

Whereas establishing a preferred skew position for a log is unquestionably beneficial to log utilization, it has been determined that log utilization can be further improved by establishing a preferred rotative position for the log. It is believed that no one, prior to this invention, has suggested the benefits of analyzing a log for rotative positioning or provided the method or means for accomplishing a desired rotative positioning of the log.

BRIEF DESCRIPTION OF THE INVENTION

The preferred embodiment of the present invention provides for the taking of measurements that enables the creation of a representative model of the entire log configuration. Generating a complete log profile in and of itself is not new as illustrated in the commonly assigned application for U.S. Pat., Ser. No. 125,019. (The computer analysis of such a complete log model is provided as a computer package under the trade mark Real Shape TM, a product of the Applied Theory Division of U.S. Natural Resources, Inc. located in Corvallis, Oreg.) However, the more advanced form of log analysis for lumber production under Real Shape TM is applied only as an improvement for skew positioning.

The present invention adds a new dimension to log analysis for lumber production. The log is initially rough centered and then rotated on an axis provided by spindles that pin the log at the rough end centers. Scanners positioned along the log length (e.g. at the center and each end) take numerous measurements of the log profile as the log is rotated. A three-dimensional model of the log is thereby created for computer analysis. The optimum fit of lumber pieces to the log model is computed. This computation finds the best fit of vertically and horizontally oriented lumber pieces to each of a number of rotative positions of the log. The rotative position that produces the optimum fit identifies the desired rotative position for the log when clamped to the saw carriage for sawing.

Real Shape TM analysis is a very thorough and complex process, the objective being to identify precisely the exact rectangular lumber pieces that will optimally fit into a three-dimensional log model at a specific rotative position of the log. For determining which rotative position is best, it may not be necessary or desirable to apply that same level of analysis to each of the selected rotative positions. For example, a pre-Real Shape analysis may determine the maximum number of one-inch by four-inch boards that will fit the log width at each rotative position, it being presumed that that position will yield the optimum fit. Other pre-Real Shape tests will likely be developed and, of course, it may turn out best that a full Real Shape analysis be applied at each rotative position.

The invention and the preferred embodiment incorporating that invention will be more clearly understood and appreciated by reference to the following detailed description and drawings.

DESCRIPTION OF THE PREFERRED EMBODIMENT

Figure 1:
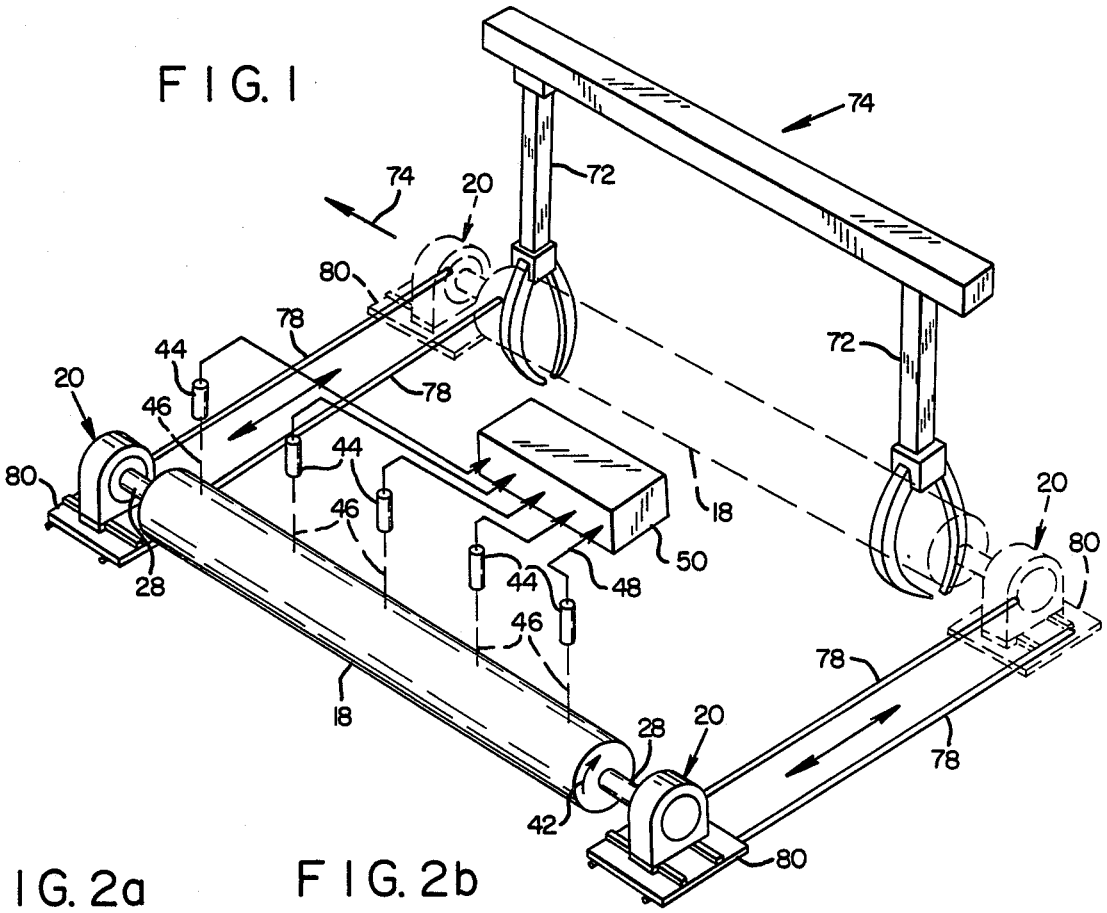
FIG. 1 is a schematic illustration of a system for orienting a log for lumber processing in accordance with the present invention.

Reference is first made to FIG. 1 of the drawings. The function of the paired log end grippers 20 are twofold. First the grippers 20 pin the ends with their spindles 28, such pinning occurring at an axis roughly through the geometric center, (as determined by a geometric centering device not shown), and the spindles then rotate the log about said axis for scanning. Such rotation occurs as indicated by arrow 42 to rotate the log under series of spaced optical scanners 44. The scanners project a laser light beam 46 on the log's surface and through its reflection, determines the precise distance to the log's surface at the point of impingement. Any number of scanning techniques are available for this purpose and they need not be restricted to electrooptical scanners. Mechanical as well as acoustical scanning devices are available. An example of optical scanning is illustrated in U.S. Pat. No. 4,246,940.

The scanner readings are taken at angular increments, e.g. every 15 degrees of rotation, and the readings are conveyed to a computer 50 as indicated by arrows 48. The log end grippers 20 are mounted on supports 80 for parallel movement on ways 78 for transferring the log in a charging capacity. The log 18 is thus transferred to side gripping dogs 72 of an overhead conveyor 74 directly from the log end grippers. The log is delivered after scanning and after the desired alignments have been computed. The transfer is thus accomplished following appropriate positioning of the log by the end grippers 20, i.e. the log is appropriately positioned for lumber cutting when engaged by the dogs 72. This positioning of the log by the end grippers 20 is specifically described in the parent application U.S. Ser. No. 150,937, U.S. Pat. No. 4,811,776.

A very significant advantage is derived from applying the rotatable and adjustable scanning spindles to lumber processing. A log was heretofore analyzed for lumber production with the log maintained at a fixed position rotatively. Thus, the log as it was delivered into the system, typically has fixed X and Y axes. An assumption is made that the saws will cut through the log parallel to its fixed Y axis. The log is thoroughly analyzed and the best pattern of lumber for the log at that rotative orientation is determined.

However, the rotative position that is utilized is arbitrary or simply selected by "eye balling", and the best solution will more likely occur at a different rotative position. Compare FIGS. *2a* and *2b*. The log of FIGS. *2a* and *2b* (the same log) has an arbitrarily selected angular orientation. The cutting pattern determined for FIG. *2a* is a pattern in the traditional X–Y axis as utilized in prior systems. A better solution may be one such as that illustrated in FIG. *2b*, i.e. at an X′–Y′ axis offset by angle a. The scanning procedure of FIG. 1 would readily make that determination by taking orthogonal dimensional data at numerous angular positions of the log, e.g. determined through Real Shape TM analysis. From this analysis, a specific X′–Y′ orientation is determined as the best rotative position, and then the log is repositioned rotatively by the angle a to align the log relative to the traditional Y axis cutting, i.e. the position of FIG. *2c*.

The preferred embodiment of the invention is illustrated in FIGS. 3 through 8. From FIG. 3, a conveyor 10 of conventional design conveys logs laterally onto a stop-and-loader 12, also of conventional design. The scanning apparatus 14 includes geometric centering V's for rough centering (upper V's 22 and lower V's 24). The logs 18 are sequentially delivered to the stop-and-loader 12 by the conveyor 10. In turn, each log is rolled from the stop-and-loader onto the V's 24 of the scanning apparatus, the lower V's being positioned in their lowered positions and the upper V's positioned in their upper position as shown in dash lines in FIG. 3. The loading of the V's is controlled by the pivotal position of the stop-and-loader 12, shown in the "stop" position in solid lines and the "loader" position in dash lines.

The V's close to the position in solid lines whereby the log is positioned so that spindles 16 are geometrically aligned centrally on the log ends. The spindles 16 are moved inward to impale the log ends. The V's open and the spindles 16 rotate to rotate the log 18. Scanners 26 take measurements of the log at determined angular increments, e.g. every 15° of rotation and conveys those measurements to a computer 50′ as indicated by arrow 30.

The computer then computes the production for each angular position as previously explained having reference to FIGS. *2a*, *2b* and *2c*. When the desired rotative position is determined, the computer 50′ instructs the drive for the spindles (arrow 32) to rotate the log to that rotative position.

The computer 50′ also determines the desired skew and offset position for the log 18 in the selected rotative position and controls the spindles 16 and/or knees 34 of carriage 36 to accomplish the desired skew and offset positioning of the log. Because a small log may be sawed only on two offsized sides and a large log may be sawed on all four sides, accordingly, the desired skewed position may be calculated for only the x axis for the large logs. The control over spindles 16 and/or knees 34 will be accordingly affected. This control phase of the operation will be subsequently discussed. First however, the transfer of the log 18 to the clamps 38 of the two knees 34 will be discussed.

Figure 5:
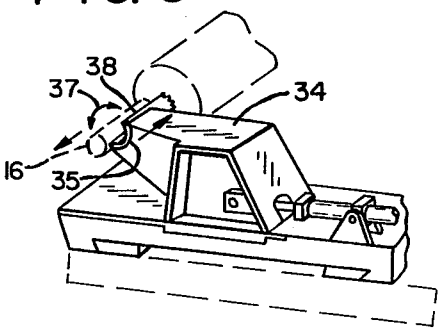
FIG. 5 is a diagrammatic view illustrating a transfer for transferring a log from the scanning apparatus to the saw carriage of the system.

A transfer mechanism is schematically illustrated in FIG. 5. The knees 34 are appropriately positioned relative to the log ends and the clamps are moved into position around the scanning spindles 16. As seen in FIG. 5, the clamps 38 are C shaped and fit around the spindles 16. The clamps are then driven into the log ends and the spindles 16 are retracted. The knees are retracted to draw the log, in the selective rotative position, onto the carriage as shown.

Figure 8:
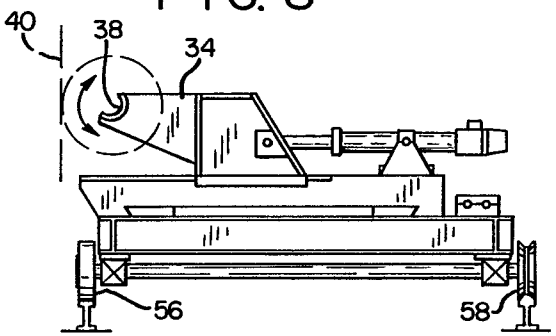
FIG. 8 is an end view of the saw carriage of FIG. 5.

It is at this point that the computer instructs the two end knees 34 of the carriage as to the desired positions for sawing slabs off of the log. The computer can precisely dictate and control independently the position of the two knees to obtain the desired cutting pattern. The carriage itself (FIGS. 6 and 7) is confined to a reciprocal movement as dictated by the tracks 52 and 54 on which the carriage rollers 56 and 58 are entrained. Roller 58 is grooved and rides on the inverted V rail of track 54 to affix the carriage position relative to the tracks. FIG. 8 illustrates the saw line 40 and it will be understood that whatever portion of the log is extended over that saw line 40 is sawed from the log. As each pass is completed, the computer controlled knees are moved further out, e.g. in two inch increments. When one side of the log is sawn down to the center cant, the log is pivoted 180° and the sawing operation is repeated for that other side. Such pivoting is permitted, e.g. by bearings at 35. It is contemplated that the transfer to the C clamps 38 would occur with the log 90° offset from its desired rotative position. The C clamp 38 would rotate 90° in one direction and then 180° back in the opposite direction in bearing 35.

In some instances, i.e. for larger logs, the log will be rotated for sawing on all four sides. Boards or flitches (sometimes referred to as slabs) will be cut continuously off the log until the center cant is as small as four inches by four inches at one end (or both ends). In order to accomplish this total sawing of a log, it is believed desirable, and perhaps necessary that the carriage clamps are spindle shaped and are pinned to the log end to the center of the area designated by the computer as the center cant. This requires a different type of transfer mechanism such as illustrated in FIGS. 10 and 11.

Figure 10A:
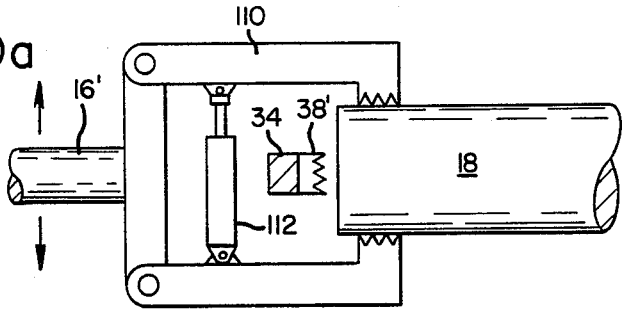
FIGS. 10*a* and 10*b* illustrate a variation of the transfer mechanism shown in FIG. 5.
Figure 10B:
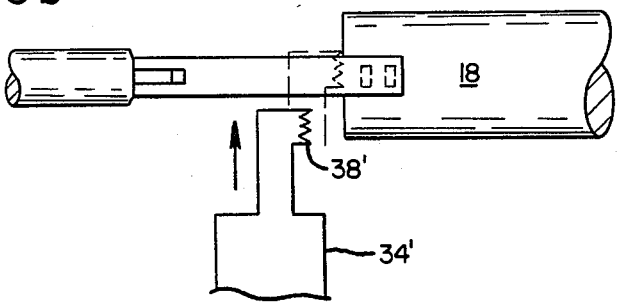

The scanning spindles cannot be pinned at a position near the log end center for holding the log when the clamps of the carriage are moved in to grip the logs at the same center position. In FIG. 10, that problem is resolved by providing the scanning spindles with means for gripping the log end sides and thereby leaving the end centers exposed for the clamps. A spindle shaft 16' is fitted with pinchers 110 and a hydraulic cylinder 112 opens and closes the pinchers 110 to clamp the sides of the log adjacent the log end. The log is rotated about shaft 16' and then rotatively positioned. The shaft 16' may be adjusted to center the designated cant positions of the log (the four inch square) relative to the carriage clamp 38' which is moved along a fixed lineal path. The clamp arms 34' will project between the pinchers as illustrated in FIGS. 10*a* and 10*b*. Lateral positioning of the clamps 38' at the log end cant position can be achieved by extending the clamps independently to the designated cant location. However, the spindle housing as disclosed in the present application is also capable of lateral positioning and in such case, both clamps 38' would simply be extended to a designated position at which the cant position is previously located by adjustment of the spindles.

It can happen that the desired rotative position for the log will place the pinchers 110 in line with the path of the clamps 38'. In this event, the computer will simply rotate the log an additional 90°, the log will be transferred to clamps 38', and clamps 38' which is designed to rotate the log in 90° increments, will simply be instructed to readjust the rotative position back to the desired selected rotative position.

Figure 11A:
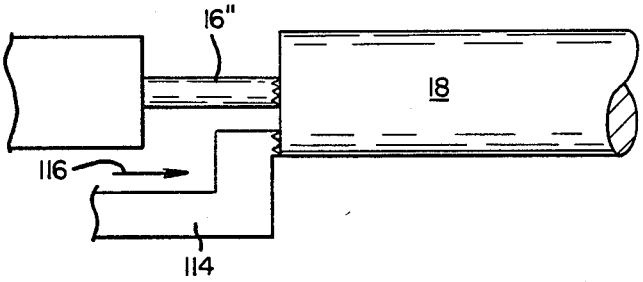
FIGS. 11*a*, 11*b* and 11*c* illustrate a further variation of the transfer mechanism shown in FIG. 5.
Figure 11B:
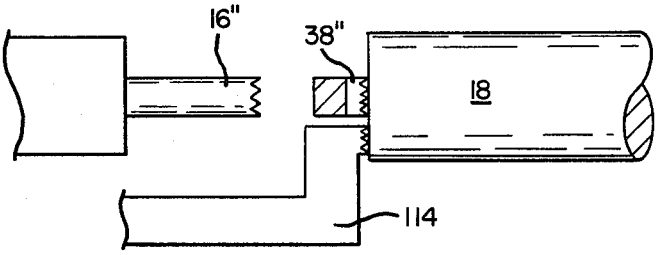
Figure 11C:
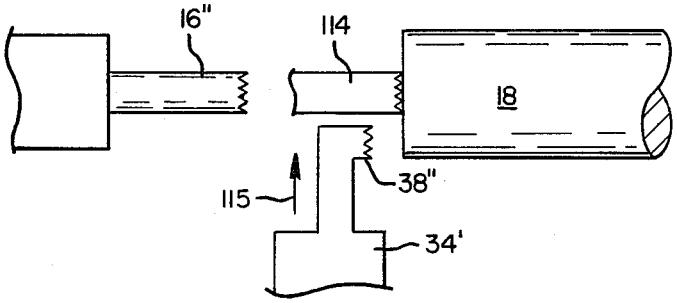

FIGS. 11*a*, 11*b* and 11*c* illustrate a further alternative to the log transfer concept. The support for spindle housing 62 (e.g. sled 66) is designed to carry a transfer clamp arm 114. When spindle 16'' (which is structured and operates exactly like spindle 16 of FIGS. 3–8) has completed its rotation and repositioning of the log 18, clamp 114 is moved against the log (arrow 116) to secure the position of the log while spindle 16'' is retracted (FIG. 11*b*). Clamp 38'' is then moved into the desired center position as indicated by arrow 115.

Figure 4:
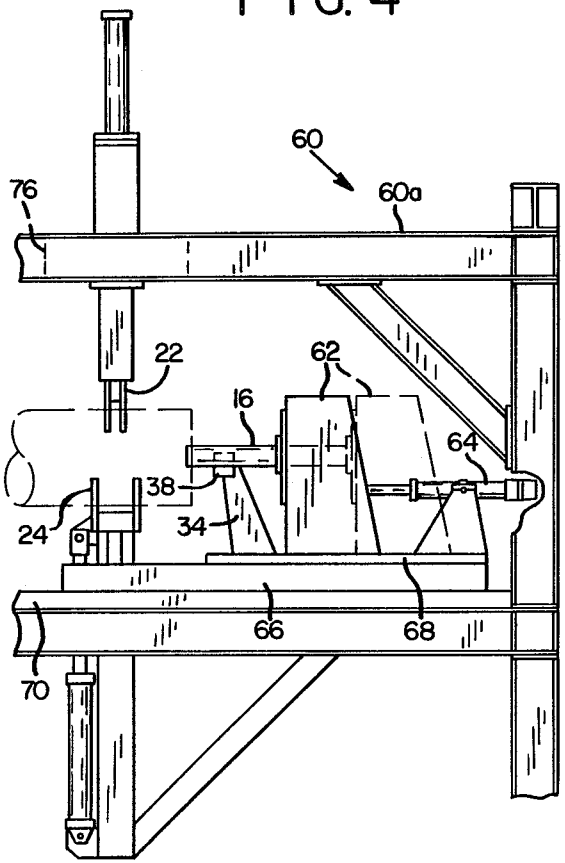
FIG. 4 is a partial side view of certain of the apparatus utilized in the system for FIG. 3 as if taken on view lines 4—4 of FIG. 3.

Returning to the embodiment of FIGS. 3–8, the general arrangement and operations have been described but a number of details have been skipped over. Logs 18 are conveyed to the scanning apparatus 14 are generally not the same length and thus it is desirable that both the scanning apparatus scan spindles 16 and carriage end clamps 38 adjust to different log lengths. The task of adjustment is made easier by arranging for the logs to be conveyed on conveyor 10 with one end of the logs in alignment. On that end, the spindle support is stationary (although the spindle is movable relative to the support for engaging and releasing a log). The spindle support at the opposite end, which also carries one set of the centering V's 22, 24, (and clamp 114 where applicable) is movable as illustrated in FIG. 4.

The scanning apparatus 14 includes a frame 60 comprised of sturdy steel beams that extends over, under and along the sides of the spindle mechanism. The spindle housing 62 at the adjustable end carries the spindle 16 and includes a drive motor for rotatably driving the spindle. The mechanism for driving the spindle and extending it relative to the housing is common to scanning spindles in present use.

The spindle housing 62 is mounted on a sled 66. The housing 62 is movable on the sled 66 through activation of the hydraulic cylinder 64 which slides the housing 62 back and forth on rails 68. The sled 66 is mounted on rails 70 that extend just over half the length of the scanning apparatus. The logs will vary between 8' and 20' in length and to accommodate such variation, the movable spindle housing must be able to close and open relative to the fixed spindle housing a distance of about 12°. Because the rough centering V's 22, 24 are preferably located near the log ends, it is necessary to also move the centering V's located adjacent the movable spindle housing.

Figure 3:
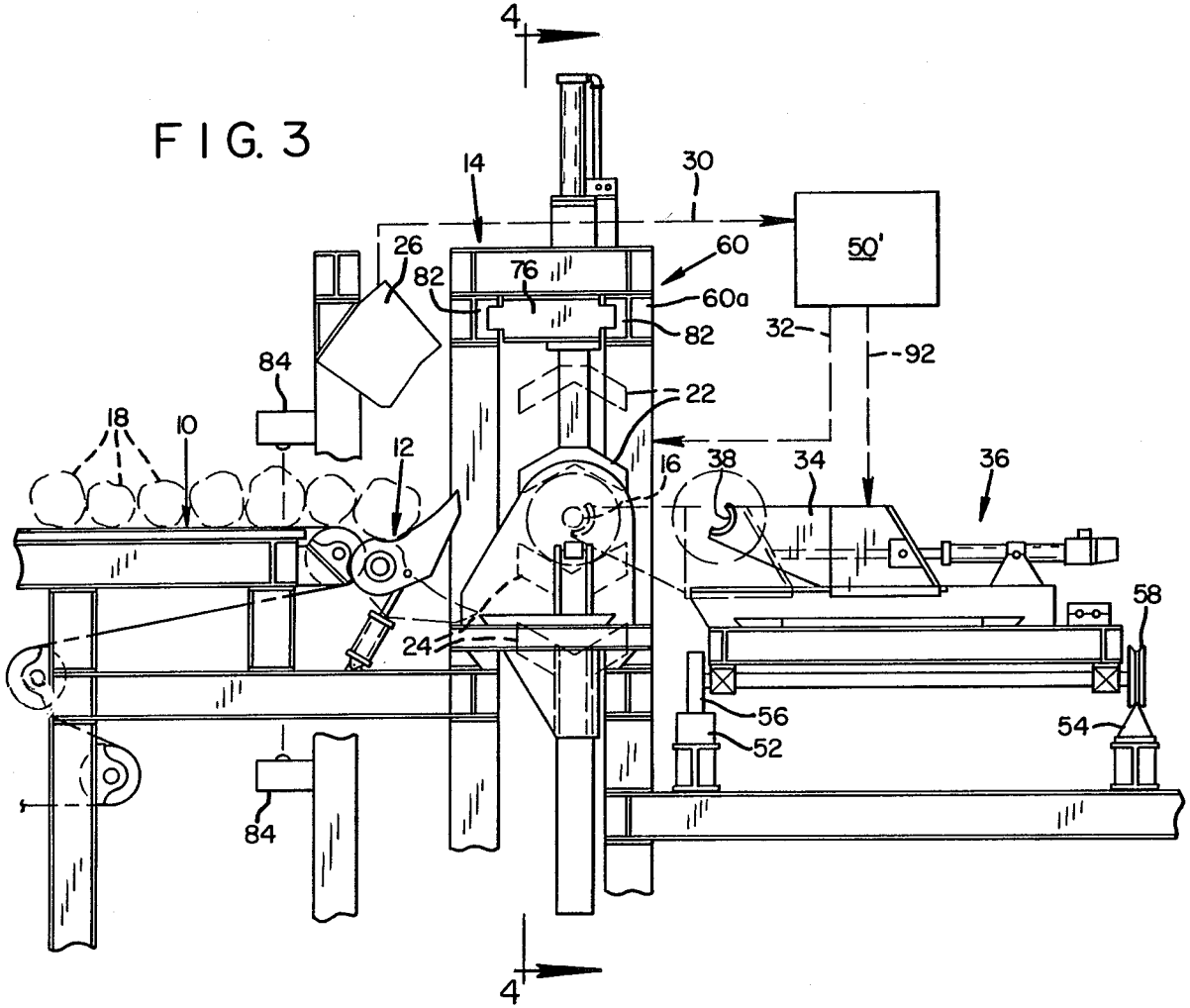
FIG. 3 is an end view of a preferred embodiment of the invention.

As noted from FIGS. 3 and 4, the lower V 24 is mounted on the sled 66. The upper V 22 is mounted on an overhead support 76 that is slidably mounted (through bearings 82) on the overhead beams 60*a* of frame 60. Hydraulic motors (not shown) connected to the sled 66 and support 76 move the sled and support back and forth to the desired distance from the fixed spindle housing as dictated by the computer 50'. The lengths of the logs are determined by occlusion scanner 84 that measures the log length, e.g. just prior to being placed on the stop-and-loader 12. The use of such scanners for determining log length is common.

In operation, as a log is transferred to the carriage 36, the computer determines the length of the next log being held by the stop-and-loader 12 and activates the hydraulic motors to properly position the upper V support 76 and sled 66. The V's are opened and the spindle housing 62 at both ends (as differentiated from the spindle support, e.g. sled 66) are retracted by motors 64. The log is rolled onto the lower V's, the V's are clamped together to rough center the log, and the motors 64 are then activated to drive spindles 16 into the log ends. The V's are retracted and the log is rotated, scanned and rotatively positioned and adjusted in the vertical and/or lateral directions as previously described.

Figure 7:
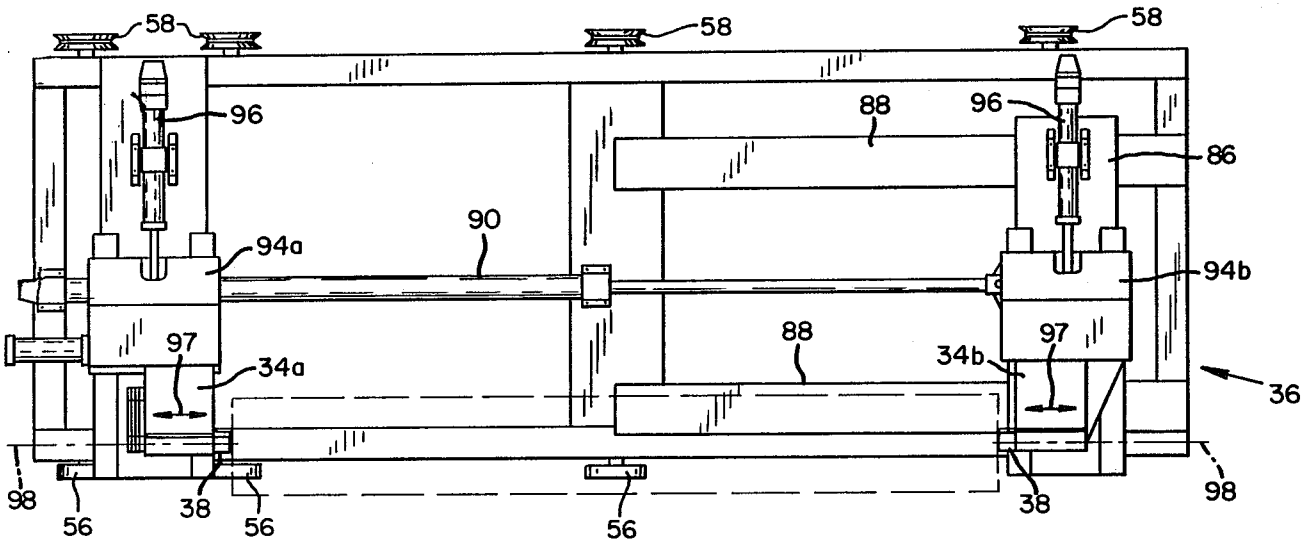
FIG. 7 is a top view of the saw carriage of FIG. 6.
Figure 6:
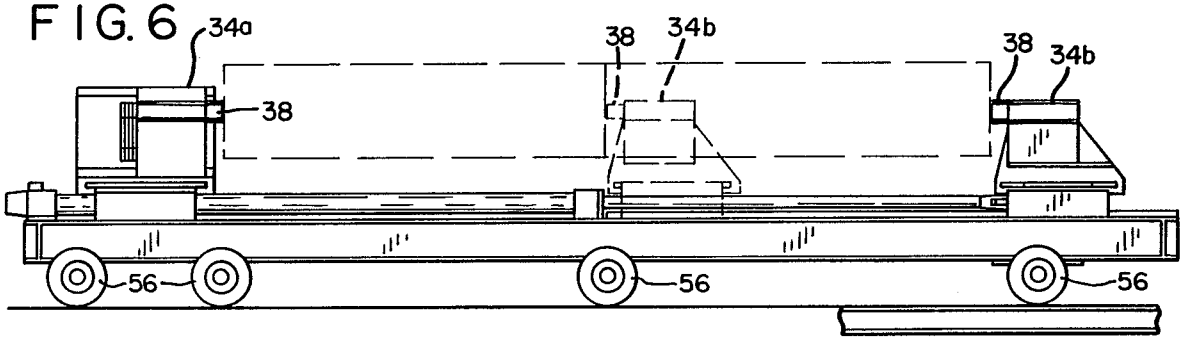
FIG. 6 is a side view of the saw carriage of FIG. 5.

The carriage knees 34 have to similarly adjust to the different log lengths. As seen in FIGS. 6 and 7, one of the knees 34*a* is mounted in a fixed housing 94*a*, i.e. on the same end as the fixed spindle housing. The other knee 34*b* is mounted in a movable housing 94*b* on said sled 86 that slides on rails 88. Hydraulic motor 90 powers the movement of sled 86 on rails 88 and the motor 90 is controlled by the computer 50' (arros 92 in FIG. 3). The knees 34*a* and 34*b* are slidable relative to their respective housings 94 (arrow 97).

Figure 9:
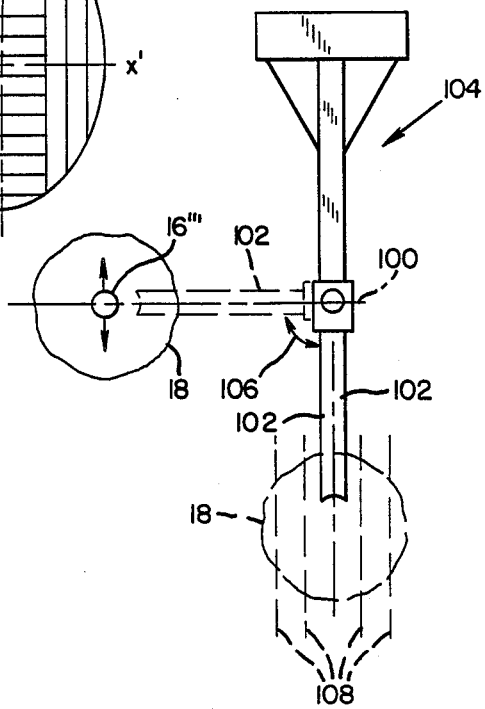
FIG. 9 is a schematic illustration of an alternate saw carriage and transfer mechanism.

Thus prior to a log being received from the scanning apparatus, the motor 90 is activated to establish the desired location of knee 34*b*. (Note the two extreme positions shown in FIG. 6.) Both clamps are axially retracted and hydraulic motors 96 are activated to extend the carriage clamps toward the log, the log being held in the desired position (rotatively, vertically and/or laterally) by spindles 16. The clamps cup the spindles as illustrated in FIG. 5 and the knees are extended axially of the log (arrow 96) to clamp the log ends with the center of the clamps 38 coinciding with the axis of the spindle 16. (Or coinciding with the position determined by the computer for the center cant, in which case transfer mechanism like that of FIGS. 9 and 10 are provided.) Hydraulic motor 96 then retracts the knees to position the log for sawing, e.g. the position illustrated in FIG. 8.

Figure 2A:
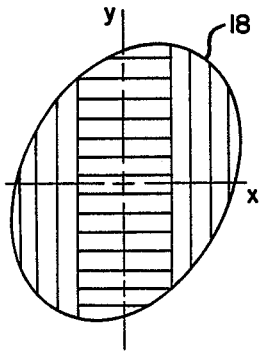
FIGS. 2*a*, 2*b* and 2*c* demonstrate the operational concept applied to the system and apparatus of FIG. 1.
Figure 2B:
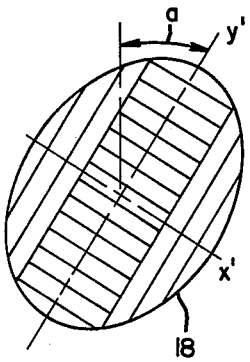
Figure 2C:
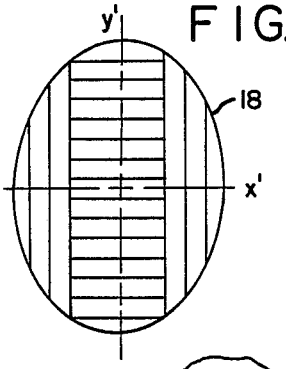

When positioning the log for sawing, the knees 34 (activated by motors 96) are independently controlled by the computer. The computer will have determined the exact positions that are desired for the log in order to generate the desired cutting pattern (see FIG. 2*c*). The computer knows the location of saw line 40 and keeps track of the location of the axis 98 relative to the clamps 38. The selected axis through the log, determined by the computer, coincides with axis 98 through the clamps 38. The scan data generated by scanners 26 develops the log configuration relative to the axis of the spindles and thus relative to axis 98. The computer is thus able to determine the desired position of the knees 34*a* and 34*b* (both skew position and depth of cut) to line up the projected cuts for the selected saw pattern with the saw line.

The difference as between the apparatus of FIG. 1 and the apparatus of FIG. 3 is that end grippers 20 of FIG. 1 perform the function of skew adjustment as well as rotation adjustment. In FIG. 3, the spindle 16 adjusts the rotative position of the log and knees 34 adjust for skew. (Again, however, if centering on the center cant is desired, vertical adjustment will also be required and both vertical and horizontal skew positioning can be accomplished by spindles 16 or clamps 38.) The primary objective is to establish a preferred rotative position as well as skew position for a log to be processed into lumber.

Whereas the Real Shape TM analysis of the log is preferred, one could also simple obtain two-dimensional planar profiles of the log at each of the rotative positions and simply fit lumber pieces to the planar profiles at the numerous rotative positions rather than to a three-dimensional model at these positions. Such simplified fitting to the numerous log positions could provide the pre-Real Shape TM testing referred to in the introductory portion above.

Other variations of mechanism for obtaining skew and rotative positions for the log will become obvious. One such "other" variation may be seen in FIG. 9. The selected rotative position is oriented 90° to the saw line, i.e. horizontal rather than vertical. The desired skew position is then established by raising and/or lowering the two end spindles 16''' relative to an axis 100 through pivotal arm portions 102 of an overhead end dog conveyor 104. With the log clamped between arms 102, the spindles 16''' are retracted and arms 102 are pivoted 90° (arrow 106). The log 18 is thereby rotatively positioned and skew positioned.

A still further variation would be to employ a conventional end log carriage (like 104 but without the pivot 106) and add an XY charger similar to that used for transferring logs to the veneer lathe in FIG. 1 of the parent application.

An advantage of the FIG. 9 embodiment is the opportunity to saw multiple slabs from the log so as to require only a single pass through a saw array indicated by saw lines 108. This may be preferable for smaller sized logs, e.g. under 20" in diameter whereas the carriage of FIG. 3 is preferable for larger sized logs.

These and other variations are considered to be within the scope of the invention which is specifically defined in the claims appended hereto.

What is claimed is:

1. A method for lumber processing comprising;

rotating a log about its approximate geometric axis, scanning the log at spaced positions along its length to obtain orthogonal X–Y dimensional data at selected angular orientations of the rotating log, analyzing the various X–Y dimensional data and determining the angular orientation for a desired cutting pattern to be derived from the log, and repositioning the angular orientation of the log for feeding the log through lumber processing saws aligned to cut the lumber pieces out of the log according to the desired cutting pattern.

2. A method as defined in claim 1 wherein the analyzing step includes determining the desired skew position of the log and including the additional step of repositioning the log to the desired skew position.

3. A system for processing logs into lumber comprising;

(a) first conveyor apparatus for conveying logs laterally, (b) a rough centering apparatus sequentially receiving the logs conveyed by the first conveyor apparatus and establishing a geometric center at each end of a log and positioning the established log end centers at a predetermined location, (c) a scanning apparatus including opposed retractable spindles for end pinning a centered log at the established log end center locations, drive means for rotating the spindles and the log thereby, and scanning means obtaining scan data of log dimensions at spaced positions along the log length and at determined rotative angular positions of the log, (d) a saw means, and conveyor clamping means receiving and clamping the log in a computer selected rotative position established for the log following scanning thereof, said conveyor clamping means conveying the log to the saw means, and adjustable means adjusting the relative position of the saw and log held by the conveyor clamping means for cutting multiple slabs from the log in accordance with a computer selected predetermined cutting pattern, and (e) computer means for collecting the scan data and from the scan data, determining the desired rotative orientation of the log and the desired cutting pattern at that rotative orientation, instructing the drive means for rotating the spindles to obtain the desired rotative orientation, and instructing the adjustable means for adjusting the position of the log relative to the saw for achieving the desired cutting pattern.

4. A system as defined in claim 3 wherein the computing means further determines the desired skew position of the log, and spindle adjustment means for adjusting the spindles to adjust the log to the desired skew position prior to the log being received by the conveyor clamping means.

5. A system as defined in claim 3 wherein the computing means further determines the desired skew position of the log, and skew adjustment means to adjust the conveyor clamping means for repositioning the log to the desired skew position.

6. A system as defined in claim 5 wherein the conveyor clamping means comprises a carriage mounted on rails for movement so as to convey a log carried thereby to the saw means, positioning knees including log end clamping means, said knees arranged at opposed ends of the carriage and mounted on the carriage for lateral movement relative to the carriage movement. Motor means for controlling said lateral movement and end clamping of the clamping means, said motor means controlled by the computer for controlling movement of the log end clamping means for clamping a scanned log and upon release by the scanned spindles for retracting the log from the scanning apparatus.

7. A system as defined in claim 6 wherein the motor means controlling movement of the positioning knees independently control the opposed end knees, and being responsive to the computer for skew positioning of the log.

8. A system as defined in claim 7 wherein one of the opposed scanning spindles is mounted on a housing that is adjustable toward and away from the other spindle to accommodate different log lengths.

9. A system as defined in claim 8 wherein one of the knees is mounted on a sled that is adjustable toward and away from the other knee to similarly accommodate different log lengths.

* * * * *